United States Patent [19]

Gregorec et al.

[11] 4,172,429

[45] Oct. 30, 1979

[54] ARRANGEMENT FOR MARKING WORKPIECES

[75] Inventors: Ladislav Gregorec, Dortmund; Konrad Klein, Dortmund-Wambel; Wilhelm Nellen; Theodor Sevenich, both of Dortmund, all of Fed. Rep. of Germany

[73] Assignee: Hoesch Werke Aktiengesellschaft, Dortmund, Fed. Rep. of Germany

[21] Appl. No.: 854,146

[22] Filed: Nov. 23, 1977

[30] Foreign Application Priority Data

Nov. 30, 1976 [DE] Fed. Rep. of Germany ..... 2654152

[51] Int. Cl.[2] ..... B05C 5/00

[52] U.S. Cl. ..... 118/696; 101/35; 118/301; 118/302

[58] Field of Search ..... 118/301, 302, 7, 4, 118/504; 101/112, 114, 35

[56] References Cited

U.S. PATENT DOCUMENTS

| | | | |
|---|---|---|---|
| 2,195,416 | 4/1940 | MacKenzie | 118/302 X |
| 2,672,842 | 3/1954 | Winters et al. | 118/2 |
| 3,143,960 | 8/1964 | Naczynski | 118/301 X |
| 3,557,689 | 1/1971 | Jeplitz | 101/35 |
| 4,066,807 | 1/1978 | Craig | 118/301 X |

*Primary Examiner*—John P. McIntosh
*Attorney, Agent, or Firm*—Max Fogiel

[57] ABSTRACT

An arrangement for marking articles or workpieces, particularly hot workpieces, such as coils of sheet metal with series of symbols which are individually applied in templates. The latter are in the form of symbols applied in a cylindrical portion and in a flange-like portion of a movable angle ring which is adjustable vertically and sideways. A spray nozzle is associated with each of the portions. The angle ring is connected to a trunnion fixed in an arm which is adjustable vertically and sideways by piston-cylinder units. One piston-cylinder unit is centered in a frame which is movable on a track by driven wheels, and the piston of this unit mounts a lifting table. Another piston-cylinder unit is connected to the aforementioned arm. One vertical spray nozzle is located above the flange-like portion of the angle ring on the outer end of the arm. A horizontal spray nozzle, furthermore, is located on the lower end of the trunnion, tiltable about a horizontal axis, inside the cylindrical portion of the angle ring. The spray nozzles are immersible by the piston-cylinder unit, in basins filled with paint solvents.

11 Claims, 2 Drawing Figures

ARRANGEMENT FOR MARKING WORKPIECES

BACKGROUND OF THE INVENTION

The present invention relates to an arrangement for the marking or labelling of goods or workpieces, particularly hot workpieces, such as coils of sheet metal, with series of symbols which are individually worked into templates (stencils), by means of paint or colored dust.

Large workpieces are ordinarily marked by hand with paint, by brush or spray guns by sequences of symbols. If they are cold workpieces, templates are used for marking. It is also known how to place figures or letters by means of bundles of seven spray guns each, where each spray gun produces a certain bar of a symbol. However, with the functioning of various spray guns there is the danger that wrong symbols are produced. Also, the spray jets always disperse and the symbols become unclear or hard to read. The difficulties do not decrease if instead of bars, dots are used to form the symbols, of if colored dust is sprayed instead of liquid paint. Also, when labelling hot workpieces, the paint dries quickly and the operators are exposed to considerable heat loads.

It is, therefore, an object of the present invention to provide an arrangement of the above type by means of which large coils, ingots, cast slabs, etc. can be marked in a short time with a series of clearly legible sharp-edged symbols without stress, particularly heat stress on the operators; the marking or labelling is to be placed both on the convex side of a bale and on the topside of the bale.

Another object of the present invention is to provide an arrangement of the foregoing character which is substantially simple in construction and may be economically fabricated.

A further object of the present invention is to provide an arrangement, as described, which may be readily maintained in service, and which has a substantially long operating life.

SUMMARY OF THE INVENTION

The objects of the present invention are achieved by providing that the templates are made in the form of symbols worked into a cylindrical part and into a flange like part of a movable angle ring adjustable vertically and sideways; a spray nozzle each is assigned to both parts of the angle ring. In a preferred embodiment, the angle ring is connected to a trunnion fixed in an arm where the arm can be adjusted laterally and vertically by means of piston-cylinder units. The piston-cylinder unit for vertical adjustment is centered in a frame which is movable by driven wheels on a track; the piston of this piston-cylinder unit mounts a lift table with the other piston-cylinder unit connected to the arm.

In a further improvement, the vertical spray nozzle is located above the flange-like parts of the angle ring on the outer end of the arm; the horizontal spray nozzle is located on the lower end of the trunnion, tiltable about a horizontal axis, inside the cylindrical part of the angle ring.

The spray nozzle can be immersed by means of further piston-cylinder units in basins filled with paint solvents. In a preferred embodiment, the horizontal spray nozzle is flexibly connected to the piston-cylinder unit attached to the trunnion; the vertical spray nozzle can be moved up and down and is connected to the piston-cylinder unit attached to the trunnion via a driven pivot arm.

For frictionless functioning, the underside of the arm has a driven cleaning brush above the flange-like part, and another driven cleaning brush is located on the trunnion inside the cylindrical part of the angle ring.

The adjustability of the labelling (marking) arrangement to the workpiece to be marked is improved if a probe actuating, via limit switches, the piston-cylinder unit which makes the lateral adjustment, is located on the one arm of the trunnion.

If round or cylindrical workpieces are marked, it is advantageous if the wheels and with them the marking device run on a circular track. The wheels are preferably driven by an electrical stepping motor with hydraulic torque amplifier.

The advantages of the arrangement of the present invention are that in a short time large workpieces, particularly hot coils can be provided with an arbitrary sequence of clearly legible symbols and that the operating personnel is not subjected to any stresses, particularly heat stress. This marking can be placed on the convex outside of a coil and on the topside of this coil.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
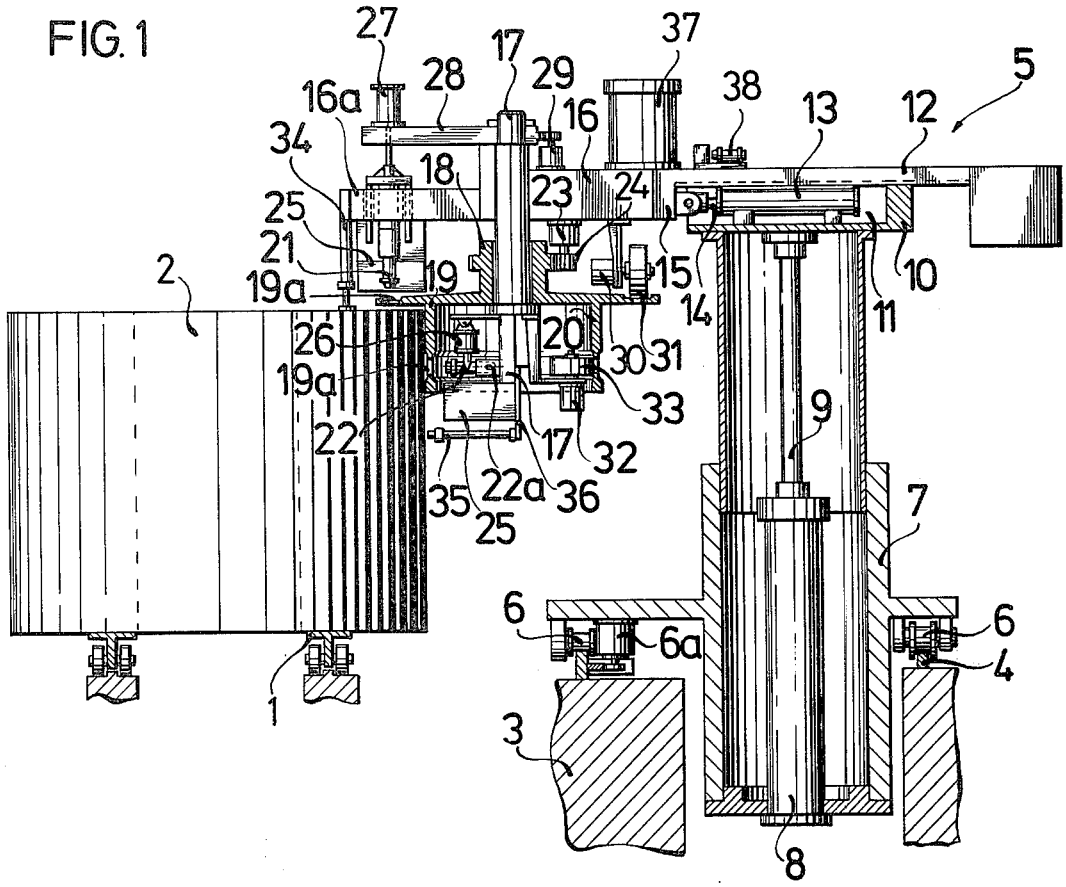
FIG. 1 shows a side view partially in section.
Figure 2:
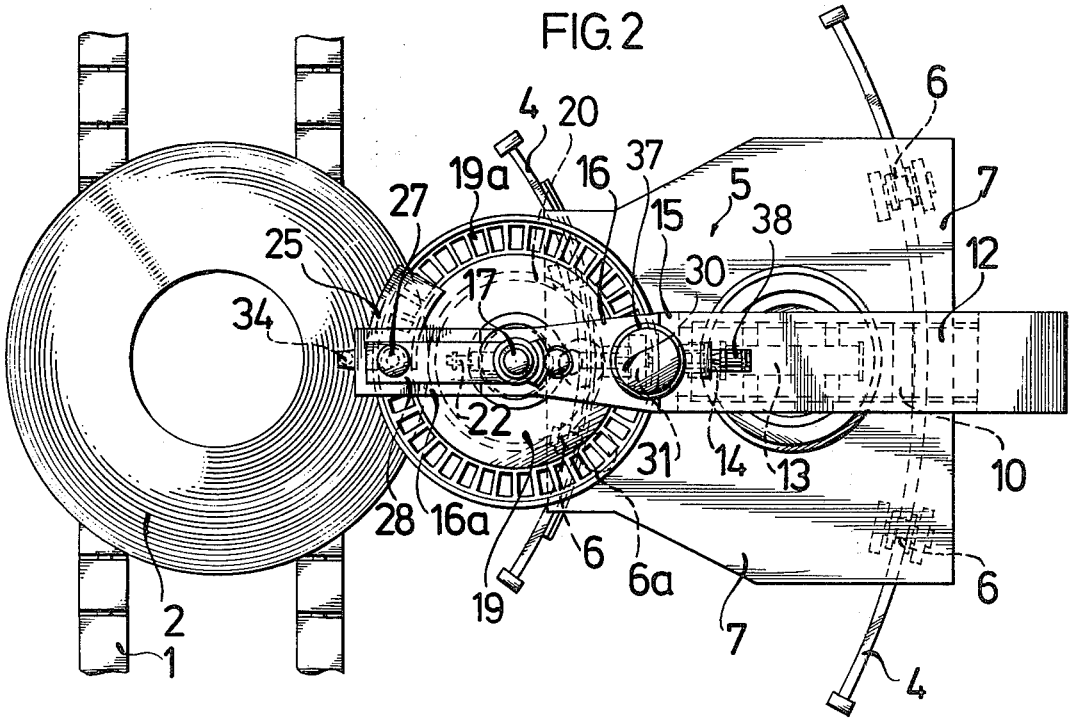
FIG. 2 shows a top view of the device of FIG. 1 in accordance with the present invention.

Referring to FIGS. 1 and 2, on a transport belt 1 or similar object, a steel ribbon wrapped into a coil is transported in a rolling mill from a reel to a coil storage area. Outside and in front of the transport belt 1 a track 4 is located on a foundation 3. On this track the marking arrangement 5 described below travels via driven wheels.

These wheels 6 are located in a frame 7 in which a piston-cylinder unit 8 with a lifting table 10 on the piston 9 is installed. The wheels 6 are driven by drive 6*a* which preferably is an electric stepping motor with hydraulic torque amplifier.

As shown in FIG. 1, the lifting table 10 has a recess 11 and has a support plate 12 covering recess 11. Recess 11 has, at right angles to the track 4, another piston-cylinder unit 13 whose piston 14 is connected to an angled portion 15 of support plate 12. By actuating the piston-cylinder unit 13, the support plate 12 can be towards and away from coil 2.

On the angled portion 15 of support plate 12, there is an arm 16 in which a trunnion 17 is fixed with its upper end. Underneath the arm 16, an angle ring 18 with a flange-like portion 19 and a cylindrical portion 20 is mounted on the trunnion 17. This cylindrical portion 20 of the angle ring 18 is provided with raised symbols 19*a* in order to place identification of coil 2 on its side outer surface.

In the same manner, the flange-like portion 19 of the angle ring 18 is equipped at its outer circumference with engraved or impressed symbols 19a so that the topside of the coil 2 can be identified.

Above the flange-like portion 19 of the angle ring 18, at the outer end of arm 16, a vertical spray nozzle 21 is provided. A horizontal spray nozzle 22 is opposite the symbols 19a engraved into the cylindrical portion 20 and is connected to the lower end of trunnion 17 tiltable about a horizontal axis 22.

The angle ring 18 is driven by means of a geared engine 23 flanged to the arm 16 and a stepping mechanism 24, whereby with each revolution of the stepping mechanism 24, the angle ring 18 is moved ahead by one symbol graduation.

After each marking process, the spray nozzles 21, 22 are cleaned or immersed into basins 25 filled with paint solvents, so that a drying of the paint used for marking in/on the spray nozzles 21, 22 is prevented till the next marking process. For this purpose, a piston-cylinder unit 26 is fastened above the spray nozzle 22, and flexibly connected with it, to trunnion 17; by means of this unit 26 the spray nozzle 22 can be immersed about the axis 22a with its opening into basin 25.

The spray nozzle 21 is also connected to a piston-cylinder unit 27 by means of which it can be moved up and down. The piston-cylinder unit 27 is located on a pivot arm 28 which pivots about trunnion 17 by means of a drive 29.

After lifting of spray nozzle 21 by means of the piston-cylinder unit 27 and pivoting of pivot arm 28, by means of a drive located on arm 16, the spray nozzle 21 can be immersed in the basin 25 on the side.

To clean the symbols 19a engraved or impressed into the flange-like part 19 of angle ring 18, the underside of the arm mounts a cleaning brush 31, driven by a motor 30, above the flange-like portion 19. In the same manner, for cleaning the symbols impressed into the cylindrical part 20 of angle ring 18, a cleaning brush 33, driven by a drive 32, is mounted on trunnion 17.

In order to position the spray nozzle 21 for each coil 2 at the same distance from the coil surface, a feeler (probe) 34 is located on an extension 16a of arm 16. This extension projects beyond the trunnion 17. With this feeler (probe) upon contacting the coil 2 via limit switches (not shown), the vertical movement of piston 9 of the piston-cylinder unit 8 is shut off.

In the same manner, the horizontal lateral movement of piston 14 of piston-cylinder unit 13 is shut off via another limit switch (not shown) if another feeler (probe) 35, which is fastened via an arm 36 to trunnion 17, touches the outermost winding of coil 2.

The marking paint is pumped from a tank 37 on the arm 16 via a pump 38, and via hose connections (not shown) to the spray nozzles 21, 22.

The track 4 is made circular for the marking of round or cylindrical workpieces as represented by the coil 2, in FIG. 2, for example. The center "a" of coil 2 is also the imaginary center of the circle arches formed by the track 4, so that the marking device 5 located on wheels 6 can travel on a circular path around coil 2.

Without further analysis, the foregoing will so fully reveal the gist of the present invention that others can, by applying current knowledge, readily adapt if for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An arrangement for marking articles or workpieces with paint or colored dust, particularly hot workpieces, such as coils of sheet metal, with series of symbols individually applied in templates, comprising: a single movable angle ring adjustable vertically and sideways and having templates in the form of symbols applied in a cylindrical portion and in a flange-like portion of said movable angle ring; said cylindrical portion being connected to said flange-like portion, a first spray nozzle being located on one side of said flange-like portion and a second spray nozzle being located in said cylindrical portion, said workpieces facing said flange-like portion and said cylindrical portion and being marked simultaneously in one operation on two surfaces by symbols of said templates.

2. An arrangement for marking articles or workpieces with paint or colored dust, particularly hot workpieces, such as coils of sheet metal, with series of symbols individually applied in templates, comprising: a movable angle ring adjustable vertically and sideways and having templates in the form of symbols applied in a cylindrical portion and in a flange-like portion of said movable angle ring; said cylindrical portion being connected to said flange-like portion; a first spray nozzle being located on one side of said flange-like portion and a second spray nozzle being located in said cylindrical portion, said workpieces facing said flange-like portion and said cylindrical portion; trunnion means connected to said angle ring; an arm, said trunnion means being fixed in said arm; and piston-cylinder means for adjusting said arm vertically and sideways.

3. An arrangement as defined in claim 2 including frame means and driven wheel means; track means, said frame means being movable on said track means by said driven wheel means; said piston-cylinder means comprising a piston-cylinder unit centered in said frame means; lifting table means mounted by said one-piston-cylinder unit, said piston-cylinder means having another piston-cylinder unit connected to said arm.

4. An arrangement as defined in claim 2 wherein said first nozzle comprises a vertical spray nozzle located above said flange-like portion of said angle ring on the outer end of said arm; said second spray nozzle comprising a horizontal nozzle located on a lower end of said trunnion means tiltable about a horizontal axis inside said cylindrical portion of said angle ring.

5. An arrangement as defined in claim 2 including container means filled with paint solvents, said first and second spray nozzles being immersible in said container means by auxiliary piston-cylinder means.

6. An arrangement as defined in claim 5 including a driven pivot arm; said auxiliary piston-cylinder means comprising one piston-cylinder unit connected flexibly to said second spray nozzle and attached to said trunnion means; said auxiliary piston-cylinder means having another piston-cylinder unit for moving said first spray nozzle up and down, said other piston-cylinder unit being attached to said trunnion means by said driven pivot arm.

7. An arrangement as defined in claim 2 including a first driven cleaning brush on the underside of said arm above said flange-like portion; and a second driven cleaning brush on said trunnion means inside said cylindrical portion.

8. An arrangement as defined in claim 2 including probe means actuating said piston-cylinder means; said arm having an extension projecting beyond said trunnion means, said probe means being located on said extension of said arm.

9. An arrangement as defined in claim 3 wherein said track means comprises a circular track, said wheel means traveling on said circular track.

10. An arrangement as defined in claim 3 including electrical stepping motor means with hydraulic torque amplifier means for driving said wheel means.

11. An arrangement as defined in claim 2 including frame means with driven wheel means; track means, said frame means being movable on said track means by said wheel means, said piston-cylinder means having piston-cylinder unit centered in said frame means; lifting table means for mounting the piston of said one piston-cylinder unit, said piston-cylinder means having another piston-cylinder unit connected to said arm; said first spray nozzle comprising a vertical nozzle located above the flange-like portion of said angle ring on the outer end of said arm; said second nozzle comprising a horizontal nozzle located on a lower end of said trunnion means tiltable about a horizontal axis inside said cylindrical portion of said angle ring; container means filled with paint solvents, said first and second spray nozzles being immersible in said container means by auxiliary piston-cylinder units; said second spray nozzle being connected flexibly to one auxiliary piston-cylinder unit attached to said trunnion means and said first spray nozzle being movable up and down; a driven pivot arm, said first spray nozzle being connected to another auxiliary piston-cylinder unit by said driven pivot arm; a driven cleaning brush on the underside of said arm above said flange-like portion; another driven cleaning brush on said trunnion means inside said cylindrical portion; probe means actuating said one piston-cylinder unit, said arm having an extension projecting beyond said trunnion means, said probe means being located on said extension of said arm; said track means comprising a circular track; and electrical stepping motor means with hydraulic torque amplifier means for driving said wheel means.

* * * * *